US008458851B2

(12) United States Patent
Louis et al.

(10) Patent No.: US 8,458,851 B2
(45) Date of Patent: Jun. 11, 2013

(54) RECOVERY TANK ASSEMBLY FOR AN EXTRACTOR CLEANING MACHINE

(75) Inventors: Jeffrey S. Louis, Akron, OH (US); David Chaney, Northfield, OH (US); Harald Krondorfer, Aurora, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 32 days.

(21) Appl. No.: 13/224,205

(22) Filed: Sep. 1, 2011

(65) Prior Publication Data

US 2012/0066859 A1 Mar. 22, 2012

Related U.S. Application Data

(60) Provisional application No. 61/379,206, filed on Sep. 1, 2010.

(51) Int. Cl.
*A47L 11/30* (2006.01)

(52) U.S. Cl.
USPC ..... 15/320; 15/327.2; 15/353; 15/410

(58) Field of Classification Search
USPC ..... 15/320, 327.2, 353, 410
IPC ..... A47L 11/30
See application file for complete search history.

(56) References Cited

U.S. PATENT DOCUMENTS

| | | | |
|---|---|---|---|
| 5,655,254 | A | 8/1997 | Bores et al. |
| 5,901,406 | A | 5/1999 | Mueller et al. |
| 5,901,408 | A | 5/1999 | Miller et al. |
| 6,154,917 | A | 12/2000 | Zahuranec et al. |
| 6,378,162 | B1 | 4/2002 | Zahuranec et al. |
| 6,412,141 | B2 | 7/2002 | Kasper et al. |
| 6,536,071 | B2 | 3/2003 | Zahuranec et al. |
| 7,159,271 | B2 | 1/2007 | Sepke et al. |
| 7,178,196 | B2 | 2/2007 | Morgan et al. |
| 7,331,082 | B2 | 2/2008 | Hertrick et al. |
| 7,430,783 | B2 | 10/2008 | Williams et al. |
| 7,475,712 | B2 | 1/2009 | McDowell |
| 7,979,951 | B2 | 7/2011 | Lenkiewicz et al. |
| 2006/0000051 | A1 | 1/2006 | Cipolla et al. |
| 2006/0123583 | A1 | 6/2006 | Parr et al. |
| 2006/0123585 | A1 | 6/2006 | O'Neal |
| 2006/0123587 | A1 | 6/2006 | Parr et al. |
| 2008/0189901 | A1 | 8/2008 | Jansen |

FOREIGN PATENT DOCUMENTS

| | | |
|---|---|---|
| WO | 2006008451 | 1/2006 |

OTHER PUBLICATIONS

PCT/US2011/050257 International Search Report and Written Opinion dated Apr. 9, 2012 (13 pages).

*Primary Examiner* — David Redding
(74) *Attorney, Agent, or Firm* — Michael Best & Friedrich LLP

(57) ABSTRACT

An extractor cleaning machine including a base or foot moveable along a surface to be cleaned, and a handle pivotally coupled to the foot and moveable between an upright storage position and an inclined operating position. The cleaning machine also includes a recovery tank insertable into a space between the foot and the handle. The handle is positioned directly over at least a portion of the recovery tank when the handle is in the upright storage position, and the recovery tank is removable from the space while the handle is in the upright storage position.

20 Claims, 5 Drawing Sheets

RECOVERY TANK ASSEMBLY FOR AN EXTRACTOR CLEANING MACHINE

CROSS-REFERENCE TO RELATED APPLICATION

This application claims the benefit of and priority to U.S. Provisional Patent Application No. 61/379,206, filed Sep. 1, 2010, the entire contents of which are hereby incorporated by reference.

BACKGROUND

The present invention relates to extractor cleaning machines and, more particularly, to recovery tank assemblies for extractor cleaning machines.

Extractor cleaning machines typically include a tank for recovering liquids and dirt drawn off of a surface that is being cleaned. Over the course of cleaning, the recovery tank fills to a capacity and needs to be drained.

SUMMARY

In some embodiments, the invention provides an extractor cleaning machine including a base moveable along a surface to be cleaned and a handle pivotally coupled to the base and moveable between an upright storage position and an inclined operating position. A recovery tank is insertable into a space between the base and the handle. The handle is positioned directly over at least a portion of the recovery tank when the handle is in the upright storage position and the recovery tank is removable from the space while the handle is in the upright storage position.

The extractor cleaning machine can be configured such that when the handle is in the upright storage position, the base and the handle include substantially parallel surfaces that together define an insertion axis, and such that the recovery tank is moved along the insertion axis during insertion into and removal from the space. The extractor cleaning machine can be configured such that the recovery tank includes substantially parallel upper and lower surfaces, and wherein when the recovery tank is inserted into the space, the upper surface faces the parallel surface of the handle, the lower surface faces the parallel surface of the base, and the upper and lower surfaces are substantially parallel to the insertion axis. The extractor cleaning machine can be configured such that the base includes a projection and the recovery tank includes a notch, and such that the projection engages the notch to secure the recovery tank to the base. The extractor cleaning machine can be configured such that the recovery tank includes a non-moveable handle for inserting and withdrawing the recovery tank into and out of the space. The extractor cleaning machine can also include a supply tank coupled to the handle for movement with the handle and positioned directly over at least the portion of the recovery tank when the handle is in the upright storage position. The base can include a distribution nozzle in fluid communication with the supply tank. The extractor cleaning machine can be configured such that the recovery tank is latchlessly connected to the base. The extractor cleaning machine can be configured such that the latchless connection between the recovery tank and the base includes a detent coupling having a portion formed on the recovery tank and a portion formed on the base.

In other embodiments, the invention provides an extractor cleaning machine including a base moveable along a surface to be cleaned, the base including a suction nozzle and a distribution nozzle. A handle is pivotally coupled to the base and is moveable between an upright storage position and an inclined operating position. A recovery tank is removably coupled to the base and is in fluid communication with the suction nozzle. A storage tank is removably coupled to the handle for movement therewith and such that at least a portion of the storage tank is positioned directly over at least a portion of the recovery tank when the handle is in the upright storage position.

The extractor cleaning machine can be configured such that the storage tank is latchlessly connected to the base. The extractor cleaning machine can be configured such that the base defines a space that receives the storage tank and includes a first guide surface for guiding the recovery tank into the space, and such that the handle includes a second guide surface for guiding the recovery tank into the space. The second guide surface can be substantially parallel to the first guide surface when the handle is in the upright storage position. The extractor cleaning machine can be configured such that the recovery tank defines an upper surface and a lower surface, and such that when the recovery tank is inserted into the space, the upper surface is substantially parallel to the second guide surface when the handle is in the upright storage position, and the lower surface is substantially parallel to the first guide surface. The extractor cleaning can be configured such that the recovery tank is insertable into and removable from the space by movement along an insertion axis. The extractor cleaning machine can be configured such that the first and second guide surfaces cooperate to guide and limit the recovery tank for the movement along the insertion axis. The extractor cleaning machine can also include a detent coupling having a portion formed on the base and a portion formed on the storage tank. The detent coupling can detently secure the recovery tank to the base when recovery tank is coupled to the base.

In still other embodiments, the invention provides an extractor cleaning machine including a base movable along a surface to be cleaned. The base includes a distribution nozzle and a suction nozzle. A handle is pivotally coupled to the base for movement between an upright storage position and an inclined operating position. A suction source is in fluid communication with the suction nozzle and is operable to draw fluid and dirt from the surface through the suction nozzle. A distributor is in fluid communication with the distribution nozzle and is operable to distribute a cleaning fluid to the surface through the distribution nozzle. A supply tank is configured to store the cleaning fluid. The supply tank is coupled to the handle such that the supply tank pivots with the handle with respect to the base. A recovery tank is in fluid communication with the suction source to receive and store the fluid and dirt drawn through the suction nozzle. The recovery tank is coupled to the base and is removable from the base when the handle is in the upright storage position. The supply tank is positioned directly above at least a portion of the recovery tank when the handle is in the upright storage position.

The extractor cleaning machine can be configured such that the base defines a cavity that receives the recovery tank. The base can include at least one guide surface for guiding the recovery tank into and out of the cavity when the recovery tank is coupled to and removed from the base. The extractor cleaning machine of can be configured such that the handle defines a second guide surface positioned over the cavity when the handle is in the upright storage position. The second guide surface can cooperate with the first guide surface to guide the recovery tank. The first and second guide surfaces can be substantially parallel to one another when the handle is in the upright storage position and can cooperate to define an insertion axis. The first and second guide surfaces can cooperate to guide and limit movement of the recovery tank solely along the insertion axis when the recovery tank is removed from the cavity when the handle is in the upright storage position. The insertion axis can extend at an angle between a substantially vertical axis defined by the handle and a substantially horizontal axis defined by the base. The angle can be between about 20 degrees and about 60 degrees above the horizontal axis. The recovery tank can be latchlessly connected to the base.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

DETAILED DESCRIPTION

Figure 1:
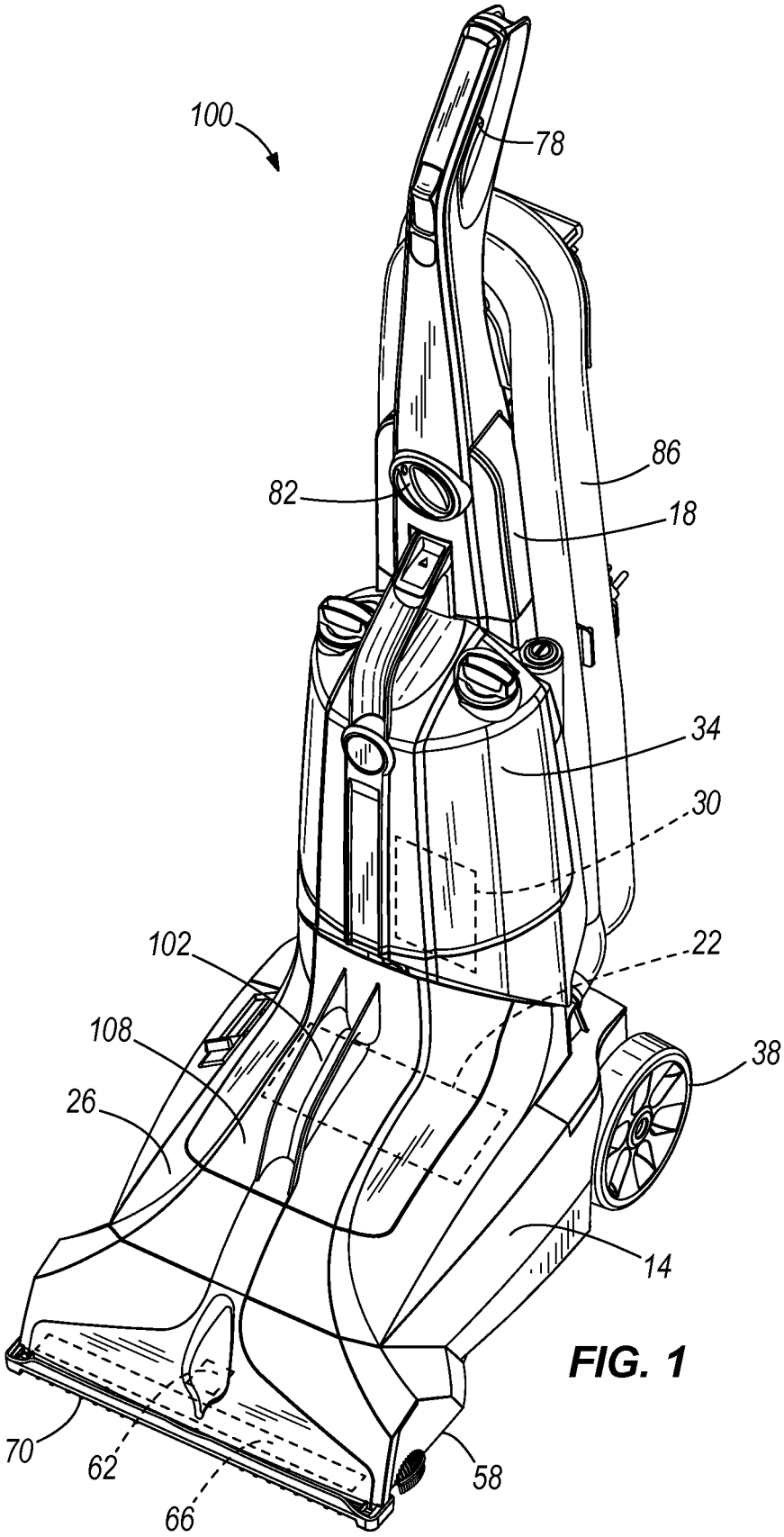
FIG. 1 is a perspective view of an extractor cleaning machine embodying the invention.

FIG. 1 illustrates an extractor cleaning machine 100 (hereinafter referred to simply as an "extractor"). In the illustrated embodiment, the extractor 100 is an upright extractor operable to clean a surface, such as, for example, a floor. In some embodiments, the extractor 100 may be adapted to clean a variety of surfaces, such as carpets, hardwood floors, tiles, or the like. The extractor 100 distributes or sprays a cleaning fluid (e.g., water, detergent, or a mixture of water and detergent) onto the surface to clean the surface. The extractor 100 then draws the cleaning fluid and any dirt off of the surface, leaving the surface relatively clean and dry.

The illustrated extractor 100 includes a base in the form of a foot 14 (other extractors, such as non-upright-type extractors, might include a different type of base), a handle 18 coupled to the foot 14, a suction source 22 supported by the foot 14, a recovery tank 26 coupled to the foot 14, a distributor 30 supported by the handle 18, and a supply tank assembly 34 coupled to the handle 18. In the illustrated embodiment, the suction source 22 is generally underneath the recovery tank 26. In other embodiments, the suction source 22 may be supported by the handle 18 or may be positioned elsewhere on the extractor 100.

The foot 14 is movable along the surface to be cleaned and supports the other components of the extractor 100. Two wheels 38 (only one of which is shown in FIG. 1) are coupled to the foot 14 to facilitate movement of the foot 14 along the surface. In the illustrated embodiment, the wheels 38 are idle wheels. In other embodiments, the wheels 38 may be driven wheels.

Figure 2:
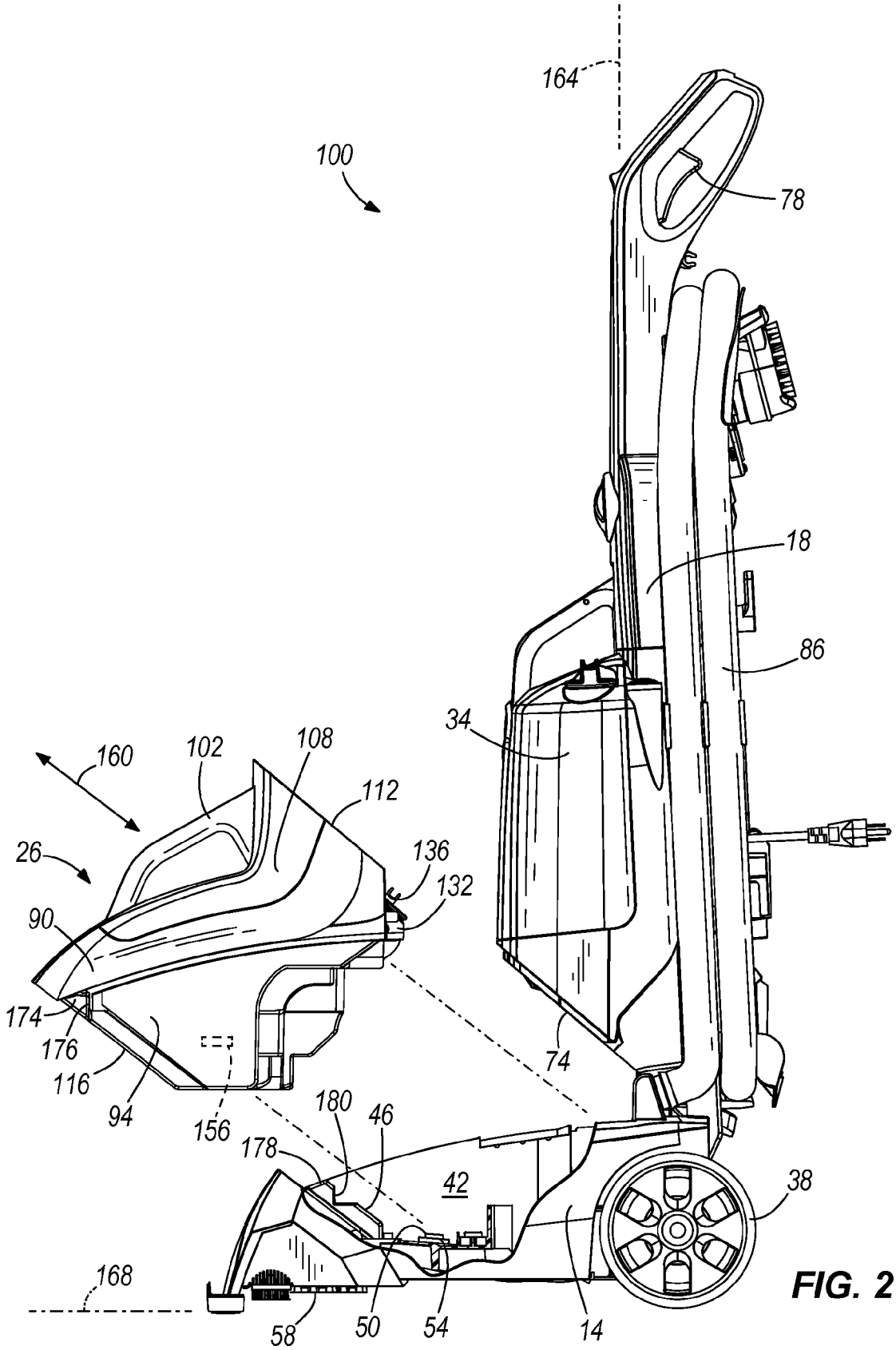
FIG. 2 is a cutaway side view of the extractor cleaning machine of FIG. 1 with a recovery tank of the extractor cleaning machine exploded.
Figure 3:
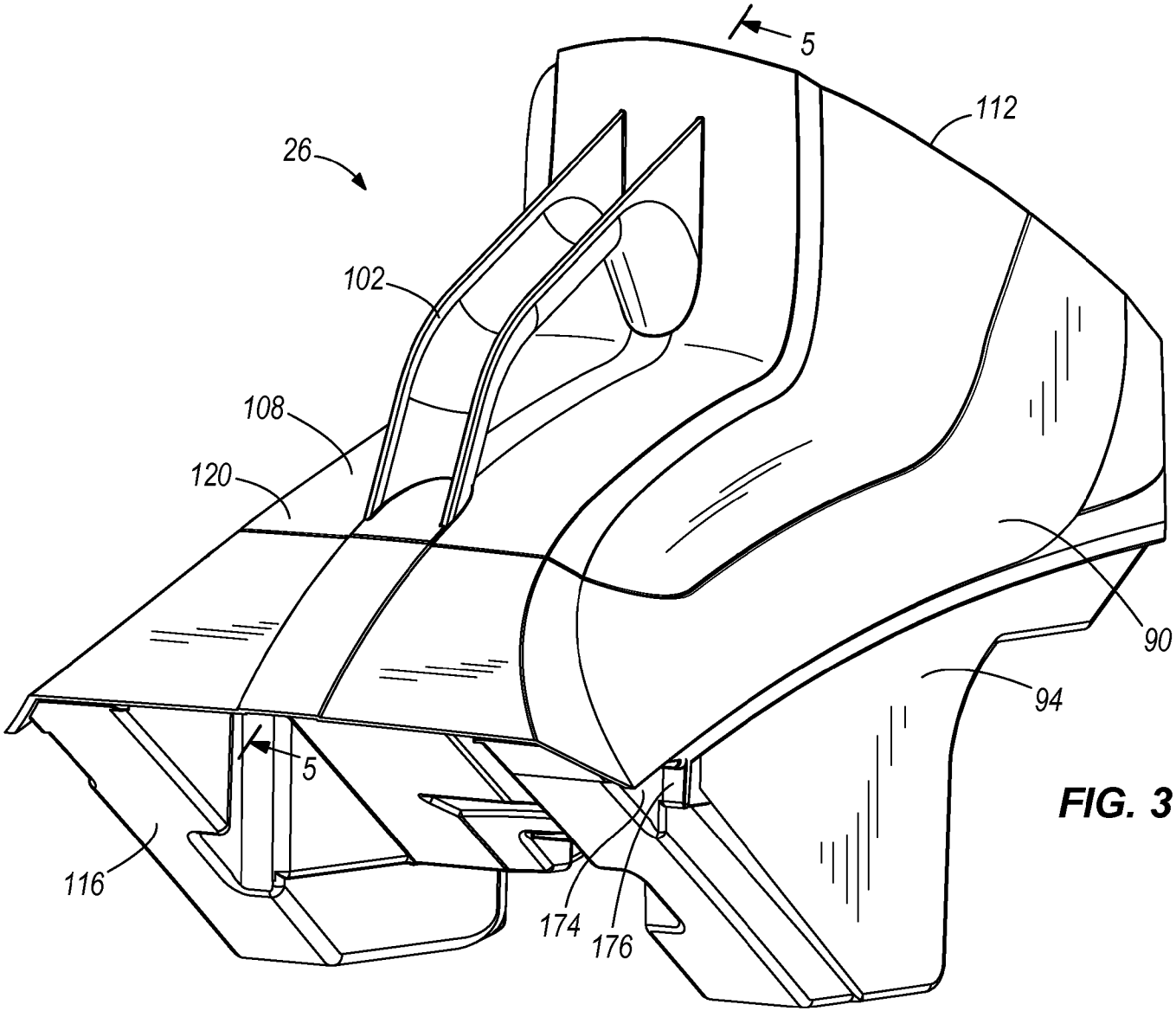
FIG. 3 is a front perspective view of the recovery tank of the extractor cleaning machine of FIG. 1.

As shown in FIG. 2, a cavity 42 is formed in the foot 14 to receive the recovery tank 26. The cavity 42 is configured with a plurality of internal guide surfaces 46. An optional magnet 50 is positioned within the cavity 42 and coupled to a similarly optional first ferromagnetic plate member 54. In alternative embodiments, the magnet 50 may be secured within the cavity by adhesive, fasteners, overmolding, or other suitable attachment methods, or may be eliminated altogether.

Referring back to FIG. 1, the foot 14 further includes a distribution nozzle 62, a suction nozzle 66, and a brush assembly 70 adjacent a lower surface 58 of the foot. The distribution nozzle 62 directs cleaning fluid toward the surface to be cleaned. The suction nozzle 66 draws fluid and dirt from the surface back into the recovery tank 26 of the extractor 100. The brush assembly 70 is coupled to the lower surface 58 adjacent the distribution and suction nozzles 62 and 66 to scrub the surface. The brush assembly 70 also helps inhibit fluid from flowing beyond a periphery of the foot 14. In some embodiments, individual brushes of the brush assembly 70 may be electrically or pneumatically rotated to agitate and scrub the surface.

The suction source 22 is in fluid communication with the suction nozzle 66 to draw fluid and dirt from the surface through the suction nozzle 66. In one embodiment, the suction source 22 includes a fan that generates a vacuum to draw the fluid and dirt through the suction nozzle 66.

The distributor 30 is in fluid communication with the distribution nozzle 62 to draw cleaning fluid from the supply tank assembly 34 and distribute the fluid to the surface through the distribution nozzle 62. The illustrated distributor 30 draws two separate cleaning fluids (e.g., water and detergent) from the supply tank assembly 34, mixes the fluids, and distributes the mixed cleaning fluid onto the surface. In some embodiments, the distributor 30 may include a pump that propels the cleaning fluid to the distribution nozzle 62. In the illustrated embodiment, the distributor 30 is supported by the handle 18 generally behind the supply tank assembly 34. In other embodiments, the distributor 30 may be supported by the foot 14 or may be positioned elsewhere on the extractor 100.

The illustrated handle 18 is pivotally coupled to and extends from the foot 14. The handle 18 is pivotable or tiltable relative to the foot 14 from a generally vertical, or upright, storage position shown in FIG. 1 to an infinite number of non-vertical, or inclined, operating positions. Pivoting the handle 18 to an operating position facilitates moving the foot 14 along the surface. As shown in FIG. 2, the handle includes a guide surface defined by an inclined lower handle surface 74 that is positioned opposite the recovery tank 26 when the recovery tank is installed in the cavity 42. Thus, the recovery tank 26 can be installed into and removed from a space defined between the surfaces 46 of the foot 14 and the surface 74 of the handle while the handle 18 is in the upright storage position.

As shown in FIGS. 1 and 2, the handle 18 supports a trigger 78 and a mode knob 82. The trigger 78 is actuatable to spray cleaning fluid from the supply tank assembly 34 through the distributor 30 and the distribution nozzle 62 and onto the surface. The mode knob 82 adjusts the operating mode (i.e., wash, rinse, auto-rinse, etc.) of the extractor 100. The illustrated handle 18 also supports an accessory hose 86. The accessory hose 86 is connectable to a variety of hand-held tools to help clean smaller surfaces, such as, for example, steps.

As shown in FIGS. 2-5, the recovery tank 26 includes an upper portion 90 and a lower portion 94. The upper portion 90 and lower portion 94 define an internal volume 98 (FIG. 5) into which dirt and liquids are received (i.e. "recovered") via the suction nozzle 66 by an airflow generated by the suction source 22. A recovery tank handle 102 is integrally formed with a detachable recovery tank lid 108 as a single component. The tank handle 102 is positioned between an upper surface 112 and a lower surface 116 of the recovery tank 26. In other embodiments, the tank handle 102 may be separately formed from the recovery tank lid 108, or coupled to another part of the recovery tank 26. A front portion 120 of the recovery tank lid 108 includes hooks or tabs 122 (FIG. 5), that engage the recovery tank upper portion 90.

Figure 4:
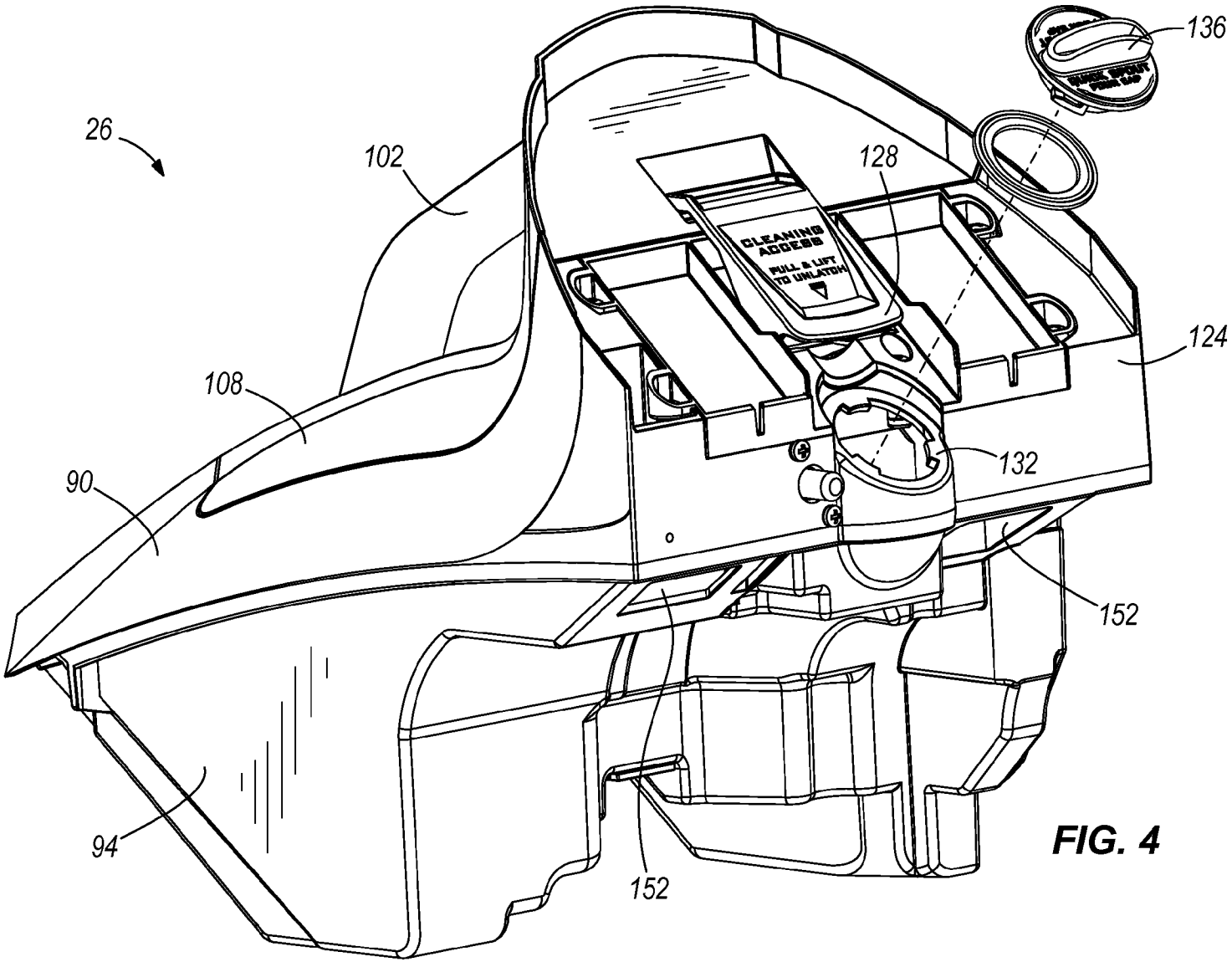
FIG. 4 is a rear partially exploded perspective view of the recovery tank of FIG. 3.

FIG. 4 is a rear perspective view of the recovery tank 26 that illustrates additional features on a rear portion 124 of the recovery tank 26, including a lid latch 128 and a pour spout 132. The lid latch 128 is provided to selectively couple the recovery tank lid 108 to the upper portion 90 of the recovery tank 26. In the illustrated embodiment, the lid latch 128 is an over-center type latch. In combination with the tabs 122 on the front portion 120, the lid latch 128 provides for selective detachment of the recovery tank lid 108 from the upper portion 90 in order to provide internal access to the internal volume 98 of the recovery tank 26 for cleaning and repair.

The rear portion 124 of the recovery tank 26 also includes a pour spout 132 and a pour spout cap 136. With the recovery tank 26 in an emptying position, (i.e., separated from the extractor 100), the pour spout 132 allows the recovery tank 26 to be drained into a point of disposal such as a sink, tub, or other disposal basin. In the illustrated embodiment, the pour spout 132 is integrally formed as one with the upper portion 90 of the recovery tank 26. The pour spout 132 projects outwardly from the rear portion 124 of the recovery tank 26 and is configured to pour out the contents of the recovery tank 26 without substantial dripping or spillage. The position of the pour spout 132 at the rear portion 124 of the recovery tank 26 is substantially opposite the tank handle 102, such that a user may drain the recovery tank 26 with one hand. Furthermore, the pour spout cap 136 is provided to close off the pour spout 132 when the recovery tank 26 is installed in the cavity 62 and when carrying the recovery tank 26 to a point of disposal. The pour spout cap 136 may be threaded into the pour spout, or may be a frictional fit. In the illustrated embodiment, the pour spout cap 136 is a quick engagement type that requires less than 90 degrees rotation between engagement and disengagement.

As illustrated in FIG. 2, the recovery tank 26 is removably coupled to the cavity 42 formed in the foot 14. The recovery tank handle 102 facilitates removing and handling the tank 26 apart from the foot 14. When installed in the cavity 42, or in an operating position, the recovery tank 26 is in fluid communication with the suction source 22 and the suction nozzle 66 to receive and store the fluid and dirt drawn through the nozzle 66.

Figure 5:
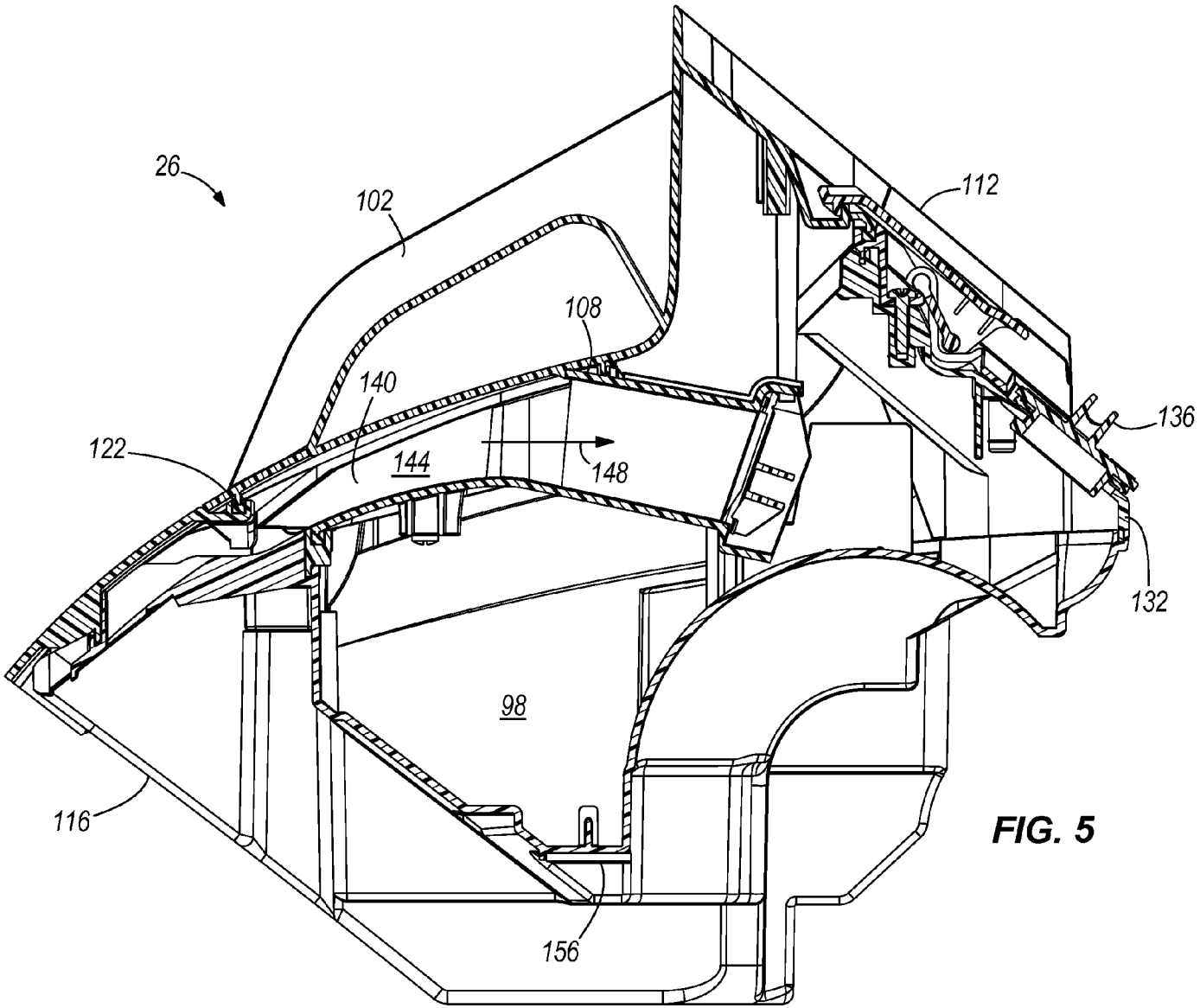
FIG. 5 is a sectional view along line 5-5 of the recovery tank of FIG. 3.

FIG. 5 is a cross section illustrating the internal configuration of the recovery tank 26. The recovery tank lid 108 includes an air/water separator 140 that defines a conduit 144. A high velocity mixed (air and water) stream from the suction nozzle 66 enters the conduit 144. The conduit 144 increases in cross sectional area in a direction of flow 148. The increasing cross-sectional area slows down the mixed stream, allowing higher-density liquids to drop out and separate from the air stream. Drains are provided in the conduit 144 so that the liquids may collect in the recovery tank 26. Air discharged from the separator 140 has a substantially reduced moisture content, allowing for subsequent filtration and exhaust in other portions of the extractor 100. The conduit 144 exhausts through ports 152 (FIG. 4) at the rear portion 124 of the recovery tank.

As shown in FIGS. 2 and 5, in embodiments including the magnet 50, an optional second ferromagnetic plate member 156 is coupled to a bottom portion of the recovery tank 26. The second ferromagnetic plate member 156 is attracted to the magnet 50 to assist in providing consistent alignment between the recovery tank 26 and foot 14. In alternative embodiments, the magnet 50 may be coupled to the recovery tank 26 for attraction to the ferromagnetic plate 54 provided on the foot 14. The magnet 50 and ferromagnetic plate members 54 and 156 are included in some embodiments to provide a more secure connection between the recovery tank 26 and the foot 14, but yet allow a user to remove the recovery tank 26 without having to operate a latch or the like. In other embodiments, additional magnets may be provided, such as an opposing magnet on the recovery tank instead of a ferromagnetic plate.

A secure connection is desired between the recovery tank 26 and the foot 14 so that the recovery tank 26 does not move or shift during operation of the extractor 100 or when the handle 18 is pivoted to the upright position. Movement of the recovery tank 26 during operation is undesirable because the recovery tank 26 is mechanically linked to other portions of the extractor 100. If the recovery tank 26 moves during operation, these connections may be compromised.

With reference to FIG. 2 the recovery tank 26 can be removed from the cavity 42 of the foot 14 without tilting the handle 18 from the illustrated upright position and without manipulating any type of supplemental latching system that secures the recovery tank 26 within the cavity 42. In this regard, the recovery tank 26 is "latchlessly connected" to the foot 14. Unlike prior art designs that include a supplemental latch that must be manipulated or otherwise disengaged to remove the recovery tank, a procedure that frequently requires the use of two hands and/or the actuation of a lever or some other moveable component, the recovery tank 26 can be removed from the cavity 42 by grasping the recovery tank handle 102, which is fixed relative to the recovery tank 26, and lifting and tilting the recovery tank 26 relative to the foot 14. In this regard, the recovery tank 26 may be conveniently removed and inserted along an insertion axis 160 oriented at an angle between a vertical axis 164, defined by the upright handle 18, and a horizontal axis 168 defined by the foot (or a floor surface). As shown in FIG. 2, the lower surface 74 of the handle 18 is substantially parallel to the insertion axis 160 when the handle 18 is upright. Similarly, the internal surfaces 46 of the cavity 42 are substantially parallel to the insertion axis 160. The upper surface 112 and the lower surface 116 of the recovery tank 26 are also substantially parallel to the insertion axis 160 during removal, insertion and use. Thus, the surfaces 46 and 74 cooperate to guide and limit movement of the recovery tank 26 along the insertion axis 160 as the recovery tank 26 is inserted into and removed from the cavity 42. In the illustrated embodiment the angle of the insertion axis 160 is about 40 degrees above the horizontal axis 168. In other embodiments, the angle of the insertion axis 160 may be between about 30 and about 50 degrees. In still other embodiments, the angle of the insertion axis 160 may be between about 20 degrees and about 60 degrees. When the recovery tank 26 is inserted into the cavity 42, the upper surface 112 faces the lower surface 74 of the handle, and the lower surface 116 faces the internal surfaces 46 of the cavity 42. The configuration of the recovery tank 26, in combination with the configuration of the cavity 42 allows for convenient insertion and removal without repositioning the handle 18 relative to the foot 14.

The recovery tank 26 and the foot 14 are also provided with cooperatively engaging detent features that combine to define a detent coupling that helps secure the recovery tank 26 within the cavity 42. Specifically, and with continuing reference to FIGS. 2 and 3, the recovery tank 26 defines a substantially triangularly-shaped notch 174 having a generally forwardly-facing wall 176. The notch 174 and the wall 176 are configured to receive and engage a corresponding engagement feature on the foot 14 in the form of a generally triangularly-shaped projection 178. The projection 178 includes a generally rearwardly-facing wall 180 that engages the forwardly-facing wall 176 when the recovery tank 26 is positioned within the cavity 42. In the illustrated embodiment, the walls 176 and 180 are both substantially flat, but in other embodiments one or both of the walls 176, 180 may be concave or convex to provide improve the engagement between the walls 176, 180.

During insertion of the recovery tank 26 into the cavity 42, the projection 178 rides along lower surfaces of the recovery tank until the wall 176 is substantially aligned with the wall 180, at which point the recovery tank 26 drops downwardly into the cavity 42 and the projection 178 is moved into engagement with the notch 174 in the recovery tank 26, at which point the recovery tank 26 is fully received by and secured within the cavity 42. The configuration provides a detent engagement between the recovery tank 26 and the foot 14. To remove the recovery tank 26 from the cavity 42, a user grasps the handle 102 and slightly rotates the recovery tank 26 in a clockwise direction as viewed in FIG. 2 to disengage the projection 178 from the notch 174 and overcome the previously-described detent engagement. The recovery tank 26 may thereafter be lifted away from the foot 14 along the recovery axis 160, all without having to move the handle 18 away from the upright position.

It should be appreciated that the arrangement of features on the foot 14 and the recovery tank 26 can be reversed without departing from the spirit and scope of the present invention. For example, the recovery tank could be provided with a projection and the foot could be provided with a notch.

Although the invention has been described in detail with reference to certain preferred embodiments, variations and modifications exist within the scope and spirit of one or more independent aspects of the invention as described.

Various features of the invention are set forth in the following claim.

What is claimed is:

1. An extractor cleaning machine comprising:

a base moveable along a surface to be cleaned;

a handle pivotally coupled to the base and moveable between an upright storage position and an inclined operating position;

a recovery tank insertable into a space between the base and the handle wherein the handle is positioned directly over at least a portion of the recovery tank when the handle is in the upright storage position and wherein the recovery tank is removable from the space while the handle is in the upright storage position wherein when the handle is in the upright storage position, the base and the handle include substantially parallel surfaces that together define an insertion axis, and wherein the recovery tank is moved along the insertion axis during insertion into and removal from the space.

2. The extractor cleaning machine of claim 1, wherein the recovery tank includes substantially parallel upper and lower surfaces, and wherein when the recovery tank is inserted into the space, the upper surface faces the parallel surface of the handle, the lower surface faces the parallel surface of the base, and the upper and lower surfaces are substantially parallel to the insertion axis.

3. The extractor cleaning machine of claim 1, wherein the base includes a projection and the recovery tank includes a notch, and wherein the projection engages the notch to secure the recovery tank to the base.

4. The extractor cleaning machine of claim 1, wherein the recovery tank includes a non-moveable handle for inserting and withdrawing the recovery tank into and out of the space.

5. The extractor cleaning machine of claim 4, further comprising a supply tank coupled to the handle for movement therewith and positioned directly over at least the portion of the recovery tank when the handle is in the upright storage position, wherein the base includes a distribution nozzle in fluid communication with the supply tank.

6. The extractor cleaning machine of claim 1, wherein the recovery tank is latchlessly connected to the base.

7. The extractor cleaning machine of claim 6, wherein the latchless connection between the recovery tank and the base includes a detent coupling having a portion formed on the recovery tank and a portion formed on the base.

8. An extractor cleaning machine comprising:

a base moveable along a surface to be cleaned, the base including a suction nozzle and a distribution nozzle;

a handle pivotally coupled to the base and moveable between an upright storage position and an inclined operating position;

a recovery tank removably coupled to the base and in fluid communication with the suction nozzle; and a storage tank removably coupled to the handle for movement therewith, wherein at least a portion of the storage tank is positioned directly over at least a portion of the recovery tank when the handle is in the upright storage position;

wherein the recovery tank is latchlessly connected to the base.

9. The extractor cleaning machine of claim 8, wherein the base defines a space that receives the storage tank and includes a first guide surface for guiding the recovery tank into the space, and wherein the handle includes a second guide surface for guiding the recovery tank into the space, and wherein the second guide surface is substantially parallel to the first guide surface when the handle is in the upright storage position.

10. The extractor cleaning machine of claim 9, wherein the recovery tank defines an upper surface and a lower surface, and wherein when the recovery tank is inserted into the space, the upper surface is substantially parallel to the second guide surface when the handle is in the upright storage position, and the lower surface is substantially parallel to the first guide surface.

11. The extractor cleaning machine of claim 8, wherein the recovery tank is insertable into and removable from the space by movement along an insertion axis.

12. The extractor cleaning machine of claim 11, wherein the base defines a space that receives the storage tank and includes a first guide surface for guiding the recovery tank into the space, and wherein the handle includes a second guide surface for guiding the recovery tank into the space, and wherein the second guide surface is substantially parallel to the first guide surface when the handle is in the upright storage position, wherein the first and second guide surfaces cooperate to guide and limit the recovery tank for the movement along the insertion axis.

13. The extractor cleaning machine of claim 8, further comprising a detent coupling having a portion formed on the base and a portion formed on the storage tank, the detent coupling detently securing the recovery tank to the base when recovery tank is coupled to the base.

14. An extractor cleaning machine comprising:

a base movable along a surface to be cleaned, the base including a distribution nozzle and a suction nozzle;

a handle pivotally coupled to the base for movement between an upright storage position and an inclined operating position;

a suction source in fluid communication with the suction nozzle, the suction source operable to draw fluid and dirt from the surface through the suction nozzle;

a distributor in fluid communication with the distribution nozzle, the distributor operable to distribute a cleaning fluid to the surface through the distribution nozzle;

a supply tank configured to store the cleaning fluid, the supply tank coupled to the handle such that the supply tank pivots with the handle with respect to the base, and a recovery tank in fluid communication with the suction source to receive and store the fluid and dirt drawn through the suction nozzle, the recovery tank coupled to the base and removable from the base when the handle is in the upright storage position, wherein the supply tank is positioned directly above at least a portion of the recovery tank when the handle is in the upright storage position.

15. The extractor cleaning machine of claim 14, wherein the base defines a cavity that receives the recovery tank, the base including at least one guide surface for guiding the recovery tank into and out of the cavity when the recovery tank is coupled to and removed from the base.

16. The extractor cleaning machine of claim 15, wherein the handle defines a second guide surface positioned over the cavity when the handle is in the upright storage position, the second guide surface cooperating with the first guide surface to guide the recovery tank.

17. The extractor cleaning machine of claim 16, wherein the first and second guide surfaces are substantially parallel to one another when the handle is in the upright storage position and cooperate to define an insertion axis, and wherein the first and second guide surfaces cooperate to guide and limit movement of the recovery tank solely along the insertion axis when the recovery tank is removed from the cavity when the handle is in the upright storage position.

18. The extractor cleaning machine of claim 17, wherein the insertion axis extends at an angle between a substantially vertical axis defined by the handle and a substantially horizontal axis defined by the base.

19. The extractor cleaning machine of claim 18, wherein the angle is between about 20 degrees and about 60 degrees above the horizontal axis.

20. The extractor cleaning machine of claim 14, wherein the recovery tank is latchlessly connected to the base.

* * * * *